US009393977B2

(12) United States Patent
Kramer et al.

(10) Patent No.: US 9,393,977 B2
(45) Date of Patent: Jul. 19, 2016

(54) END OF TRAIN VIDEO SYSTEM

(71) Applicants: Mark T. Kramer, Cape Charles, VA (US); George E. Toth, Columbia, MD (US); Gary W. Egerton, Silver Springs, MD (US)

(72) Inventors: Mark T. Kramer, Cape Charles, VA (US); George E. Toth, Columbia, MD (US); Gary W. Egerton, Silver Springs, MD (US)

(73) Assignee: WISE ELECTRONICS, LLC, Silver Spring, MD (US)

( * ) Notice: Subject to any disclaimer, the term of this patent is extended or adjusted under 35 U.S.C. 154(b) by 339 days.

(21) Appl. No.: 14/147,170

(22) Filed: Jan. 3, 2014

(65) Prior Publication Data

US 2014/0183303 A1 Jul. 3, 2014

Related U.S. Application Data

(60) Provisional application No. 61/748,447, filed on Jan. 3, 2013.

(51) Int. Cl.
*B61L 15/00* (2006.01)
*B61L 27/00* (2006.01)

(52) U.S. Cl.
CPC ..... *B61L 15/009* (2013.01); *B61L 15/0027* (2013.01); *B61L 27/0094* (2013.01)

(58) Field of Classification Search
CPC ... B61L 15/00; B61L 15/009; B61L 15/0027; B61L 15/0054
See application file for complete search history.

(56) References Cited

U.S. PATENT DOCUMENTS 5,376,925 A * 12/1994 Crisafulli ..... B61L 15/0027 246/167 R
5,978,718 A * 11/1999 Kull ..... B61L 3/008 246/167 R
6,088,635 A * 7/2000 Cox ..... B61L 23/041 246/115
6,184,781 B1 * 2/2001 Ramakesavan ..... B60Q 1/52 340/435
7,096,096 B2 * 8/2006 Kane ..... B61L 15/0027 246/122 R
7,317,987 B2 * 1/2008 Nahla ..... B61L 25/021 701/19
7,446,650 B2 * 11/2008 Scholfield ..... B60C 23/00 340/425.5
7,965,312 B2 * 6/2011 Chung ..... B61L 15/0027 348/116
8,452,502 B2 * 5/2013 Katayama ..... G07C 5/0858 340/436
8,913,131 B2 * 12/2014 Chung ..... 348/148
9,128,638 B2 * 9/2015 Goergen ..... G06F 3/0604
2005/0125113 A1 * 6/2005 Wheeler ..... B61L 3/127 701/19
2006/0151672 A1 * 7/2006 Heddebaut ..... B61L 3/125 246/121
2007/0112481 A1 * 5/2007 Tsai ..... B61L 23/042 701/19
2007/0145196 A1 * 6/2007 Davenport ..... B61G 7/14 246/1 C
2007/0216771 A1 * 9/2007 Kumar ..... B61L 23/044 348/148
2010/0148013 A1 * 6/2010 Bhotika ..... B61G 7/14 246/1 C
2010/0213321 A1 * 8/2010 Kane ..... B61L 15/0027 246/167 R
2011/0251742 A1 * 10/2011 Haas ..... B61L 15/0054 701/19
2014/0183303 A1 * 7/2014 Kramer ..... B61L 15/009 246/167 R

* cited by examiner

*Primary Examiner* — Jason C Smith
(74) *Attorney, Agent, or Firm* — Ober, Kaler, Grimes & Shriver; Royal W. Craig

(57) ABSTRACT

A viewing system for trains that makes real time visual information in the form of images or video of the vicinity of the end of a train available to a locomotive operator or distant user. The system gathers images or video of the vicinity of the end of a train and transmits and displays the images or video to a remote display on a locomotive or at a remote location off the train. The invention also records the images or video such that the images or video can be recalled and used at a later time.

28 Claims, 7 Drawing Sheets

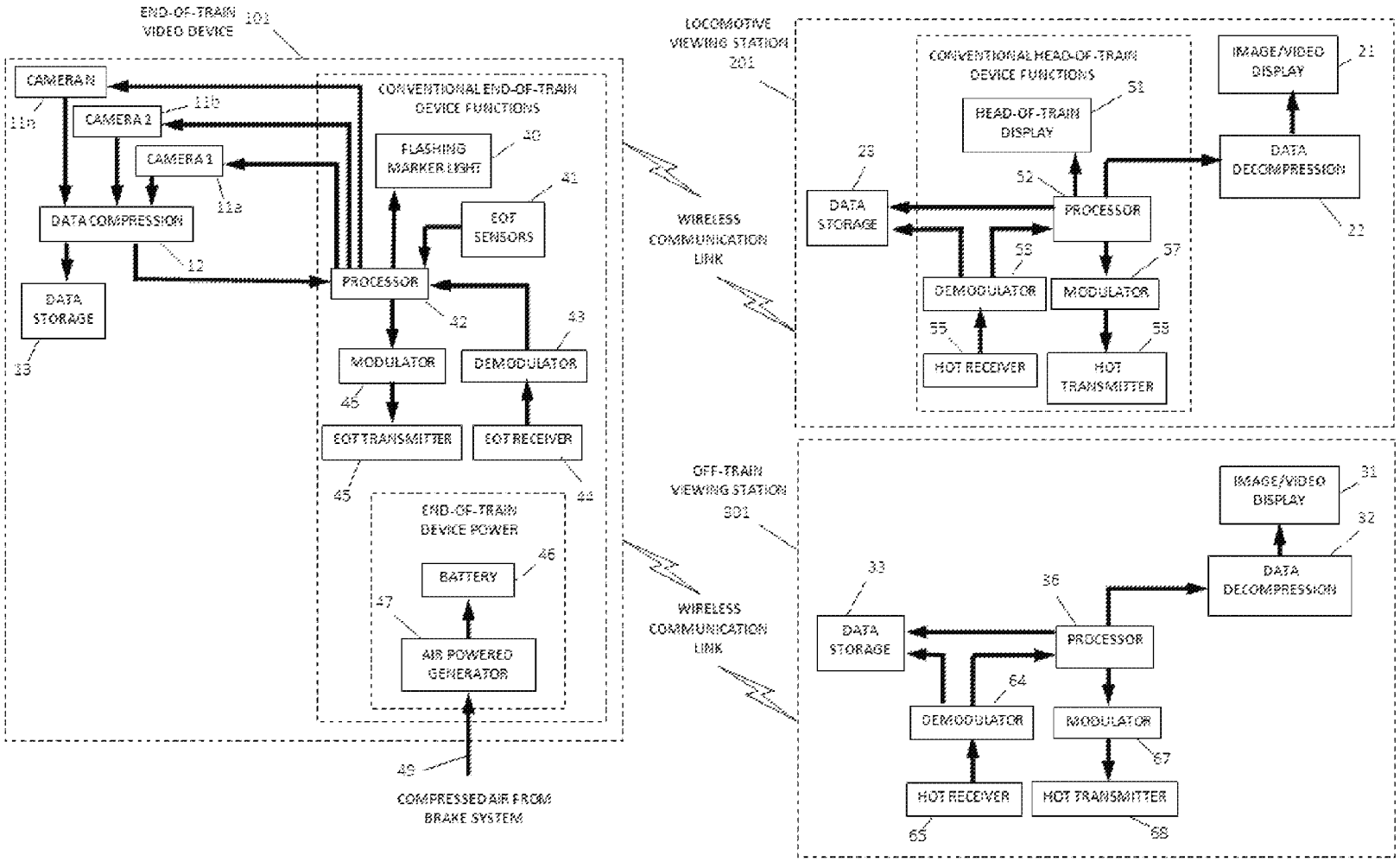
FIGURE 3– An end of train video system integral with the end-of-train telemetry equipment for trains with conventional air brakes

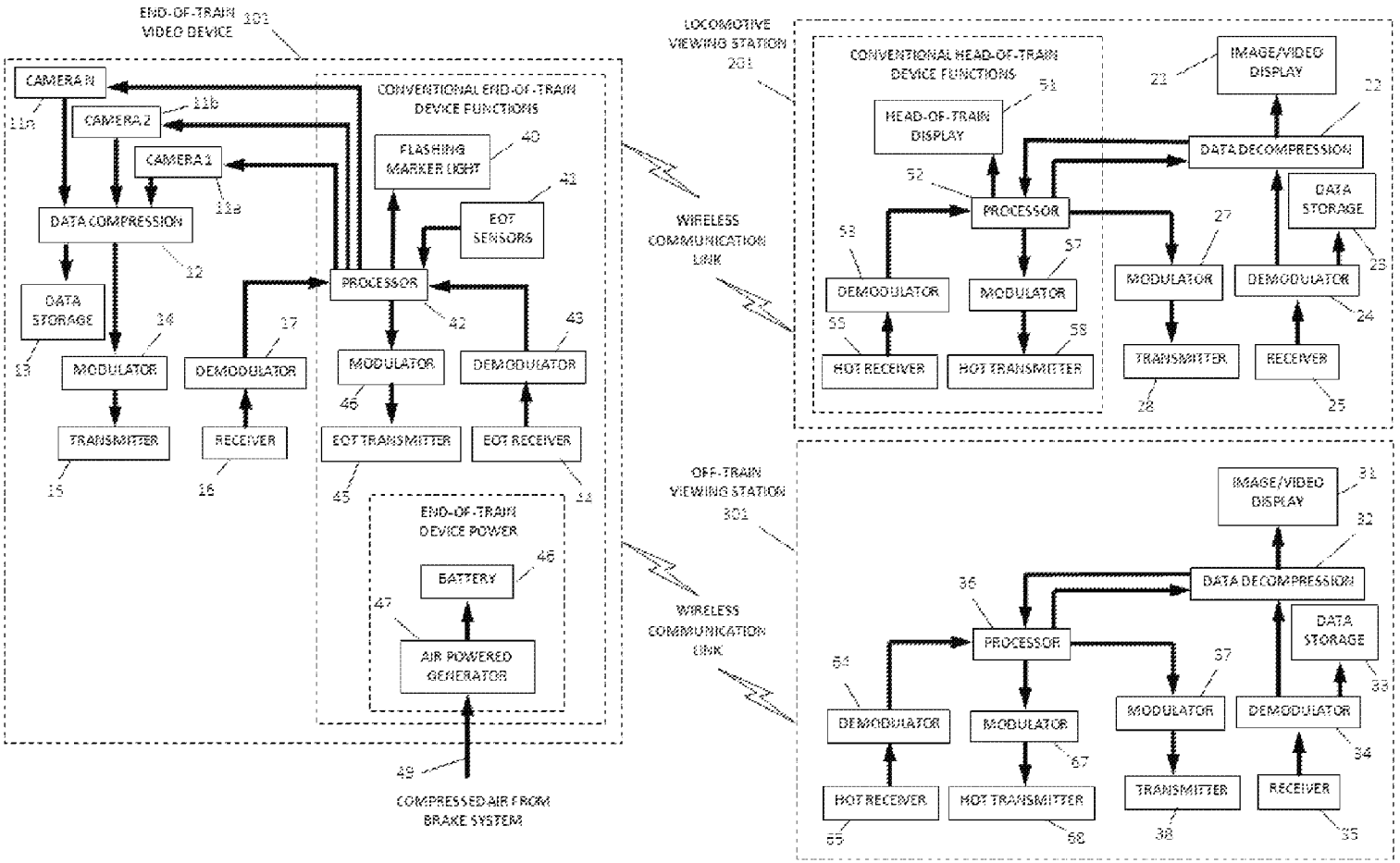
FIGURE 3A– An end of train video system integral with the end-of-train telemetry equipment for trains with conventional air brakes, with video data transmitted and received on a separate radio system from that used for conventional EOT messages.

END OF TRAIN VIDEO SYSTEM

CROSS-REFERENCE TO RELATED APPLICATION(S)

The present application derives priority from U.S. provisional application Ser. No. 61/748,447 filed 3 Jan. 2013.

BACKGROUND OF THE INVENTION (1) Field of the Invention

The present invention relates to video surveillance systems and, more particularly, to a viewing system for providing real time images or video taken in the vicinity of the end of a train to a display in a forward locomotive or remote location, and for recording the images and video for later use.

(2) Description of Prior Art

Railroad locomotives are often equipped with cameras that record views from the locomotive for use in accident investigations, training, or other purposes.

For example, U.S. Pat. No. 7,965,312 to Chung et al. issued Jun. 21, 2011 shows a wireless video recorder and recording system for generating landmark-correlated images taken from a railroad locomotive.

Similarly, U.S. Pat. No. 6,088,635 to Cox et al. issued Jul. 11, 2000 shows a railroad vehicle accident video recorder mounted on a locomotive.

U.S. Pat. No. 5,978,718 to Kull issued Nov. 2, 1999 shows a rail vision system that looks for upcoming wayside signal devices and automatically operates the brakes of the train.

These devices fulfill their respective requirements and objectives, however the patents do not disclose any means to provide real time vision-based information at the rear end of a train to an operator in a locomotive.

Locomotive operators are generally located far from the end of the train and cannot visually observe surroundings near the train end. Nevertheless, many situations require accurately knowing conditions at the train end, such as the movement of the train end or the presence of a tripped signal, or the location of the train end relative to switches, crossings, etc. Heretofore, a locomotive operator could only monitor observed circumstances at the train end by voice radio contact or hand signals from a second observer located at the end of the train.

Operators could also estimate the position of the end of the train by subtracting the known train length from locomotive odometer readings or GPS coordinates of the locomotive (on those locomotives equipped with odometers or GPS devices). However, these devices can only estimate the train end position within several meters and substantial uncertainty of the end of train position still exists. Accuracy, certainty and ultimately safety can all be enhanced if only the operator could have available real time visual images or video of the end of train vicinity that eliminated uncertainty of the train end conditions or the train end location relative to switches, crossings, etc.

End-of-train devices are well-known, such as those shown in U.S. patent application 20100213321, U.S. Pat. No. 5,376,925 and U.S. Pat. No. 7,096,096. These devices transmit non-visual, instrumentation information such as acceleration, motion or GPS coordinates to a head-of-train device in the locomotive, where the transmitted information is displayed to the locomotive operator. Non-visual, instrumentation information can be useful. However such information requires interpretation and is not as comprehensive as motion, positional and other information conveyed by visual images or video. What is needed is an end-of-train video system suited for providing real-time video surveillance from the end-of-train to a display located in the locomotive or at a remote station.

Moreover, there is a need for recorded images or video from the end of train vicinity for accident and security investigations or other purposes. U.S. Pat. Nos. 7,965,312B2, 6,088,635 and 5,978,718 show locomotive video recording systems. The systems heretofore devised and utilized consist of familiar, expected and obvious configurations that are generally arranged for the purpose of recording events and circumstances in the vicinity of the locomotive, which is typically located at the front of a train. These devices fulfill their respective requirements and objectives, however the patents do not disclose any means to record vision-based information at the end of a train. What is needed is an end-of-train video system suited for providing recorded images and video surveillance from the end-of-train vicinity.

SUMMARY OF THE INVENTION

Accordingly, it is an object of the present invention to provide real time images or video of the end of train vicinity to the distant locomotive train operator or another observer located off of the train.

Another object of the invention is to record images or video of the end of train vicinity for later use on a recording device located at the end of the train, on the locomotive or off of the train.

In accordance with the foregoing and other objects, the present invention is an end-of-train video system that uses paired sets of communication equipment, one located at the end of the train and another on the locomotive or other remote location off of the train. The equipment sets may communicate point to point using wires or fiber optics, or wirelessly using radios. If radio communication is used, a unique identifier code that uniquely identifies the radio transmitter is embedded in the messages sent between the sets of communication equipment, such that the radio receiver can discriminate between messages sent by other similarly equipped trains or observers and a message sent by the transmitter of the intended train or observer. The receiving equipment will then disregard messages sent from other trains or observers and only display or act on messages sent by the intended train or observer.

At the end of the train, the communication equipment includes one or more imaging devices to gather visual images, including both still and video images, from the end of train vicinity and convert them to electrical signals. Data processing equipment will then compress the imaging data and convert the electrical signals to a form suitable for transmission to the locomotive or other remote location off of the train.

At the locomotive or other remote location off of the train, the communication equipment will receive the transmissions, which will be decoded and decompressed to read the original message. The equipment will have additional electronics to convert the original message into a form suitable for displaying the images or video on a screen near the locomotive operator or other observer. In a preferred embodiment, the locomotive operator or other screen observer can also send command messages to the equipment at the end of the train, control the cameras and determine when images or video are sent.

In addition to displaying the images or video from the end of train vicinity in real time in the locomotive or at other remote sites off the train, the system can record the images or video for later use. The image data can be recorded in equipment at the end of the train, or alternately the transmitted message data could be recorded in equipment on the locomotive or at a site off of the train.

Those skilled in the art will observe that several of the required system features presently exist in a railroad telemetry end-of-train device (EOT) and head-of-train device (HOT). A preferred embodiment of the system would be to augment the conventional capabilities of an EOT with a means to capture and transmit images or video and an HOT with a means to receive the image or video transmissions and display those images or video on a screen near the locomotive operator or other observer, and/or to record same.

BRIEF DESCRIPTION OF THE DRAWINGS

Other objects, features, and advantages of the present invention will become more apparent from the following detailed description of the preferred embodiments and certain modifications thereof when taken together with the accompanying drawings in which:

FIG. 3 is a block diagram of an end-of-train video system integrated into end-of-train telemetry equipment for trains with conventional air brakes.

FIG. 3A is a block diagram of an end-of-train video system integrated into end-of-train telemetry equipment for trains with conventional air brakes, that transmits and receives video data on a separate radio system from that used for conventional EOT messages.

DETAILED DESCRIPTION OF THE PREFERRED EMBODIMENTS

The present invention is an end-of-train video system for providing real-time and recorded video surveillance from the end of the train to a remote display located in the locomotive or near another observer located off of the train. One having ordinary skill in the art will understand that the terms "video", "image" and "imaging data" are used interchangeably herein to describe the imaging data utilized by the end of train video system according to the present invention, which may be used to record, transmit, display and/or store video images, still images, or both.

Figure 1:
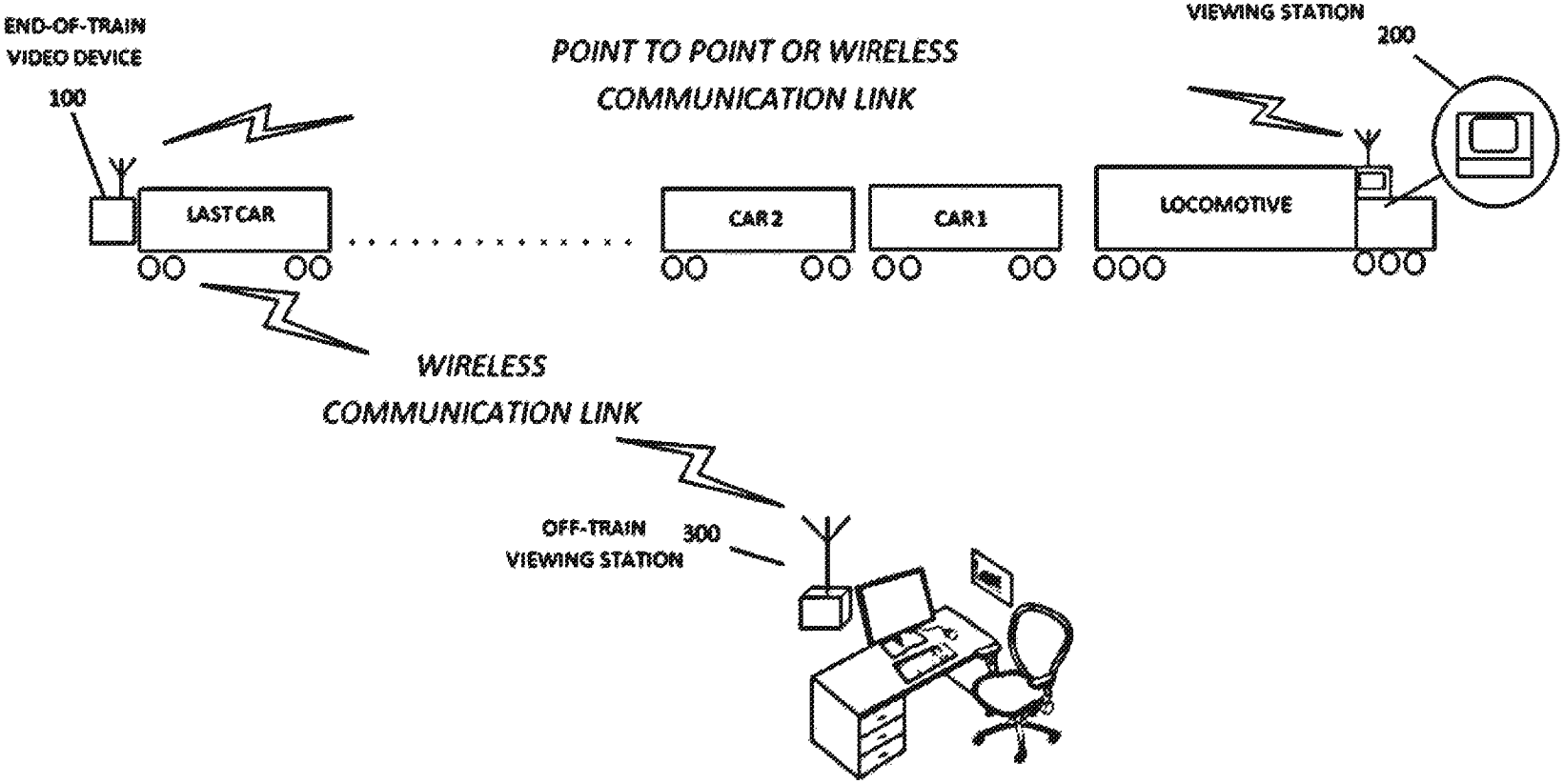
FIG. 1 depicts an end of train video system with an end-of-train video device at the end of a train, a locomotive viewing station at the front of the train and a viewing station off of the train.

FIG. 1 shows the end of train video system with an end of train viewing device 100 at the end of the train, a locomotive viewing station 200 at the front of the train and a remote off-train viewing station 300 located off of the train. End of train video device 100 can transmit data to and receive data from the locomotive viewing station 200 or the off-train viewing station 300. The end of train video device 100 may communicate point-to-point with the locomotive viewing station 200 over wires or fiber optics, or wirelessly with a radio or other wireless communication link. The end of train video device 100 will use a radio or other wireless communication link to communicate with off-train viewing station 300.

Multiple trains and viewing stations may be equipped with these video systems. When radio communication is used, some means is required to avoid displaying images or video from other trains or obeying control commands from other viewing stations, and to only display images or video from the intended train or only obey the control commands from the intended viewing station. The present system embeds a unique identifier code that uniquely identifies the end of train video device in messages sent between sets of communication equipment, such that the receiving communication equipment can discriminate between messages sent by other similarly equipped trains or off-train viewing stations and a message sent by the intended equipment. The receiving equipment disregards messages sent from other trains or off-train viewing stations that lack the unique identifier code and only displays or acts on messages with the unique identifier code sent by the intended transmitter.

Figure 2:
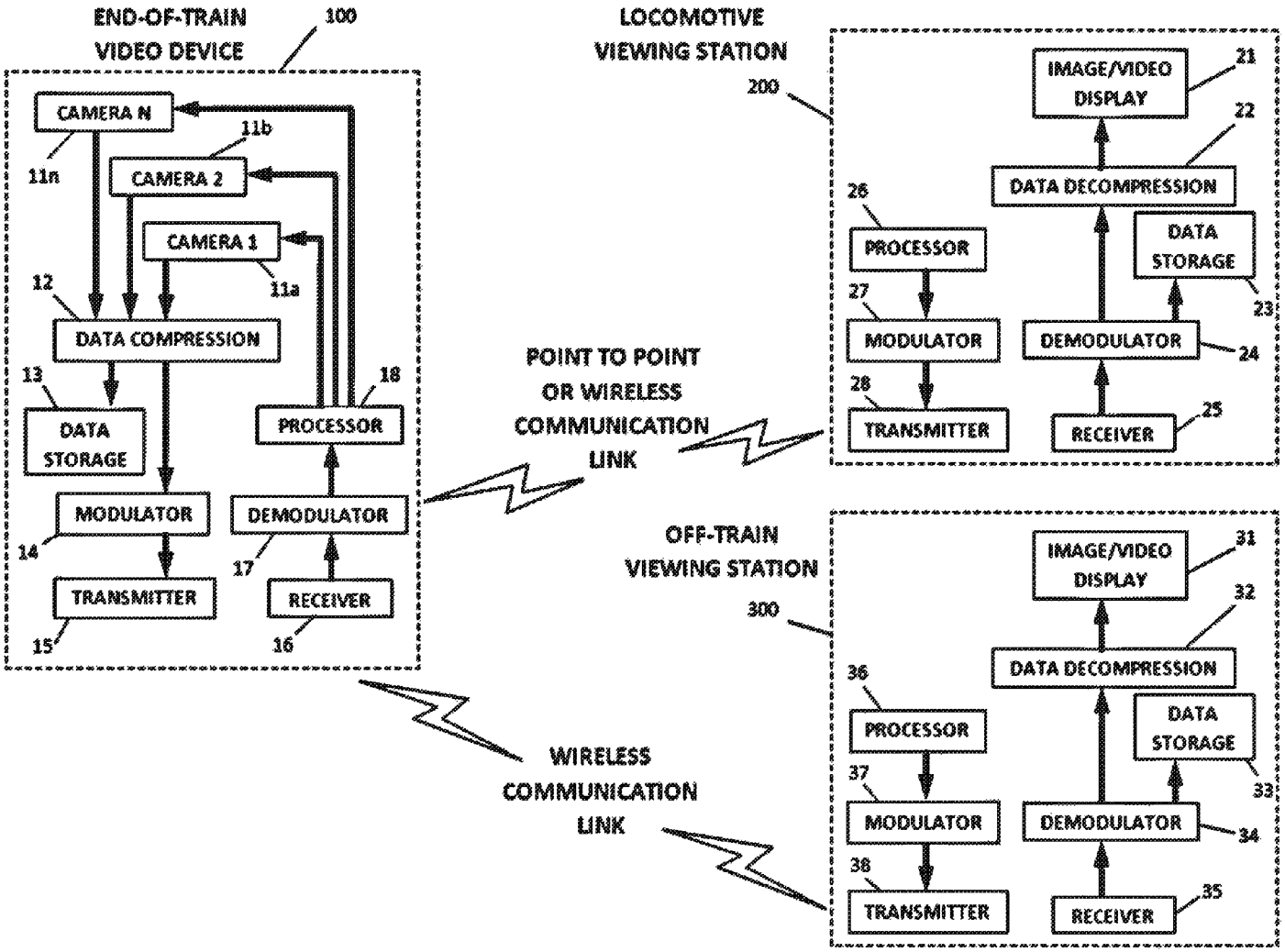
FIG. 2 is a block diagram of the end-of-train video system.

FIG. 2 is a block diagram of the end of train video system 100 and viewing stations 200 and 300. The end of the train video device 100 includes one or more imaging devices (11*a*, 11*b* . . . 11*n*), such as CCD cameras, that gather visual images (including video or still images) from the end of train vicinity and convert them to electrical signals. These individual imaging devices may reside within the end of train device 100 as shown. Alternately, the imaging devices 11*a*, 11*b* . . . 11*n* may be remote standalone devices connected via wires to the end of train device 100, or in wireless communication with the end of train device 100 for transmission of imaging data to and receipt of control commands from the end of train device 100. Large image and video data files will transmit slowly over a communication link with limited data capacity or bandwidth. To increase the data transmission rate, data processing equipment 12 compresses the imaging data using data compression techniques, such as JPEG or MPEG, and reduces the amount of data sent over the communication link. The data is then sent to a modulator 14 and transmitter 15 that convert the electrical signals to a form suitable for transmission to the locomotive or off-train viewing stations 200 or 300, respectively.

The modulator 14 transforms binary data from the processor 18 into a form that the transmitter 15 can accept to make a transmission. Thus, processor 18 adds the unique identifier code to the video data so that the receiving communication equipment can discriminate between messages sent by other similarly equipped trains or off-train viewing stations.

Locomotive viewing station 200 or off-train viewing station 300 will receive the transmission on a receiver 25 or 35. Receivers 25, 35 are in communication with demodulators 24 or 34 which demodulate the message back into the original compressed data. A data processor 22 or 32 is then used to decompress the data and recover the original image or video data. Only radio messages with the unique identifier code from the intended end of train video device 100 are accepted for display and/or recording, while messages lacking the unique identifier code from other trains will be rejected and discarded. The equipment will have additional electronics to convert the original message into a form suitable for displaying the images or video on a screen 21 or 31, such as a thin film transistor liquid crystal display (TFT-LCD) screen. The screen will be conveniently located near the locomotive operator or the off-train viewing station observer.

In a preferred embodiment, a screen observer can use the locomotive viewing station 200 or off-train viewing station 300 to send command messages to the end of the train video system 100 and control when images or video are sent by the end of the train video device 100, choose which camera (11*a*, 11*b*, . . . 11*n*) is active and control the camera settings, such as focus, pan, zoom, lighting, etc. Command messages originate in the processor 26 or 36 of the locomotive viewing station or off-train viewing station 200 and 300, respectively. Data from processors 26 or 36 are sent to modulators 27 and 37 and transmitters 28 and 38 for transmission to the end of train system 100 where they are received by receiver 16. Demodulator 17 will then demodulate the message into a form suitable for processor 18 to control the intended camera (11*a*, 11*b*, . . . 11*n*). When radio communication is used, the command messages will have a unique identifier code embedded therein that uniquely identifies the end of train video device 100 to distinguish commands from the intended transmitter 28 or 38 from those transmitted by other similarly equipped viewing stations. The end of train video device 100 will only obey command messages with the unique identifier code from the intended viewing station 200 or 300 and disregard messages lacking the unique identifier code from other viewing stations.

In addition to displaying the images or video from the end of train vicinity in real time at the locomotive or at other remote sites off the train, the system can record the images or video for later use. FIG. 2 shows data storage device 13 in the end of train video device 100. Image or video data captured by the imaging devices (11, 11*a*, . . . 11*n*) is compressed with the data compression device 12 and stored in the data storage device 13. Compressing the image or video files permits the storage of more image or video data in the limited memory of data storage 13 than is possible with uncompressed image or video files.

Alternately, the transmitted image or video data could be recorded in the locomotive viewing station 200 or the off-train viewing station 300. FIG. 2 shows data storage devices 23 and 33 in the locomotive viewing station 200 and off-train viewing station 300. Image or video data transmissions would be demodulated in demodulators 24 or 34 to reconstruct the original compressed image or video file. The compressed image or video file is then stored in data storage devices 23 or 33. If radio communication is used, only radio transmitted image or video files with the proper identifier code from the intended end of train video device 100 would be recorded, and image or video files lacking the unique identifier code from the intended end of train video device 100 would be discarded. The stored image or video data in data storage devices 13, 23 and 33 can then be accessed or downloaded to image/video displays 21, 31 or to other devices, for playback at a later time.

A conventional end-of-train device mounts to the end of a train, has an electrical power source, marks the train end with a flashing marker light and uses radio telemetry equipment to transmit and receive data embedded with a unique identifier code to and from the locomotive head-of-train device. The data transmitted in these radio messages can include brake pipe pressure, train movement, battery state of charge and other conditions collected by sensors 41 (See FIGS. 3, 3A and 5) in the EOT. These radio messages will be referred to herein as conventional EOT messages.

A conventional head-of-train device mounts in the locomotive and uses similar telemetry equipment to receive and transmit data embedded with a unique identifier code from and to the end-of-train device. The data in these radio messages can include emergency valve commands, communication test queries and other information. These radio messages will be referred to herein as conventional HOT messages. Prior to use, an HOT operator is required to input the unique identifier code of the intended EOT into the HOT device, which then embeds the same unique identifier code into all messages sent by the HOT and causes the HOT to reject all messages that lack the unique identifier code. Thereafter, the HOT and EOT become paired sets of communication equipment, and the HOT will only accept messages with the unique identifier code from the intended EOT and the EOT will only accept messages with the unique identifier code from the intended HOT.

Those skilled in the art will observe that the mount, electrical power, lighting, and telemetry equipment available in conventional railroad end-of-train telemetry systems lacking video capability could satisfy several requirements of the end of train video system. A preferred embodiment of the system would be to augment a conventional end of train device with video capability by adding a means to capture, record and transmit images and/or video to viewing stations and a means to receive camera control commands from viewing stations. The preferred embodiment would additionally augment a conventional head of train device with video capability by adding a means to receive and display image and/or video transmission data and a means to transmit camera control commands.

FIG. 3 shows a block diagram of an end of train video system 101 that has been made integral with conventional end-of-train telemetry equipment for trains with conventional air brakes. The end of train video device 101 has the conventional capabilities of an EOT augmented with a means to capture, transmit and record images or video, and locomotive viewing station 201 has the conventional capabilities of a HOT augmented with a means to receive & display video data from the end of train video device 101. FIG. 3 also depicts novel off-train viewing station 301, which, as more fully described below, may operate through the use of a conventional head-of-train (HOT) receiver 65 and transmitter 68. In one embodiment of the present invention, the end of train video system communicates with the same radios (transmitters 45, 58 or 68, and receivers 44, 55 or 65) used for conventional end-of-train telemetry devices lacking video capability. Here, the image or video data would be appended to the conventional EOT radio message within processor 42 prior to modulation & transmission via modulator 46 and transmitter 45. Alternately, the image or video data could be generated as a separate radio message within processor 42 and transmitted by the same mechanism in an independent radio message from the conventional EOT data message.

The message bearing video data will be received by HOT receivers 55 or 65 at a viewing station, where it would be processed using demodulators 53 or 64, and processors 52 or 36. The video data will then be decompressed with data decompression 22 or 32 and viewed on video display 21 or 31. This embodiment is advantageous in that only one radio system need be installed and maintained in the EOT and each viewing station.

The amount of data to be transmitted and received grows as the requirement for image or video quality increases. Displaying high quality images or video at viewing stations may require higher data transmission and reception rates than available in some low data rate radios used to carry conventional EOT and HOT messages. In such cases, the video system may be equipped with a separate high data rate radio system that has the high speed data transmission and reception rates required for displaying the images and video. Conventional EOT and HOT messages would then be transmitted and received in the traditional manner on a low data rate radio system, while image & video data is transmitted and received over the separate high data rate radio system. Thus, image and video data transmission and reception is completely separate and independent from conventional EOT and HOT messages and the low data rate radio system that carries them.

FIG. 3A shows such an arrangement, where end of train device 101 transmits conventional EOT messages from transmitter 45 and image or video data in an independent message on separate transmitter 15. The conventional EOT message is received at viewing stations 201 or 301 on HOT receiver 55 or 65, and the independent image and video data message is received on separate receiver 25 or 35. The video data is then processed with demodulators 24 or 34 and data decompression 22 or 32 for viewing on image/video display 21 or 31. Note that all forms of the image or video data message would have a unique identifier code that uniquely identifies the end of train video device 101, such that the receiving viewing station processor 52 or 36 can discriminate between messages sent by other telemetry devices on similarly equipped trains and messages sent by the end of train video device 101 on the intended train. The viewing station processor will then reject messages lacking the unique identifier code and only display image or video data from messages bearing the unique identifier code sent by the end of train video device 101 on the intended train.

Figure 4:
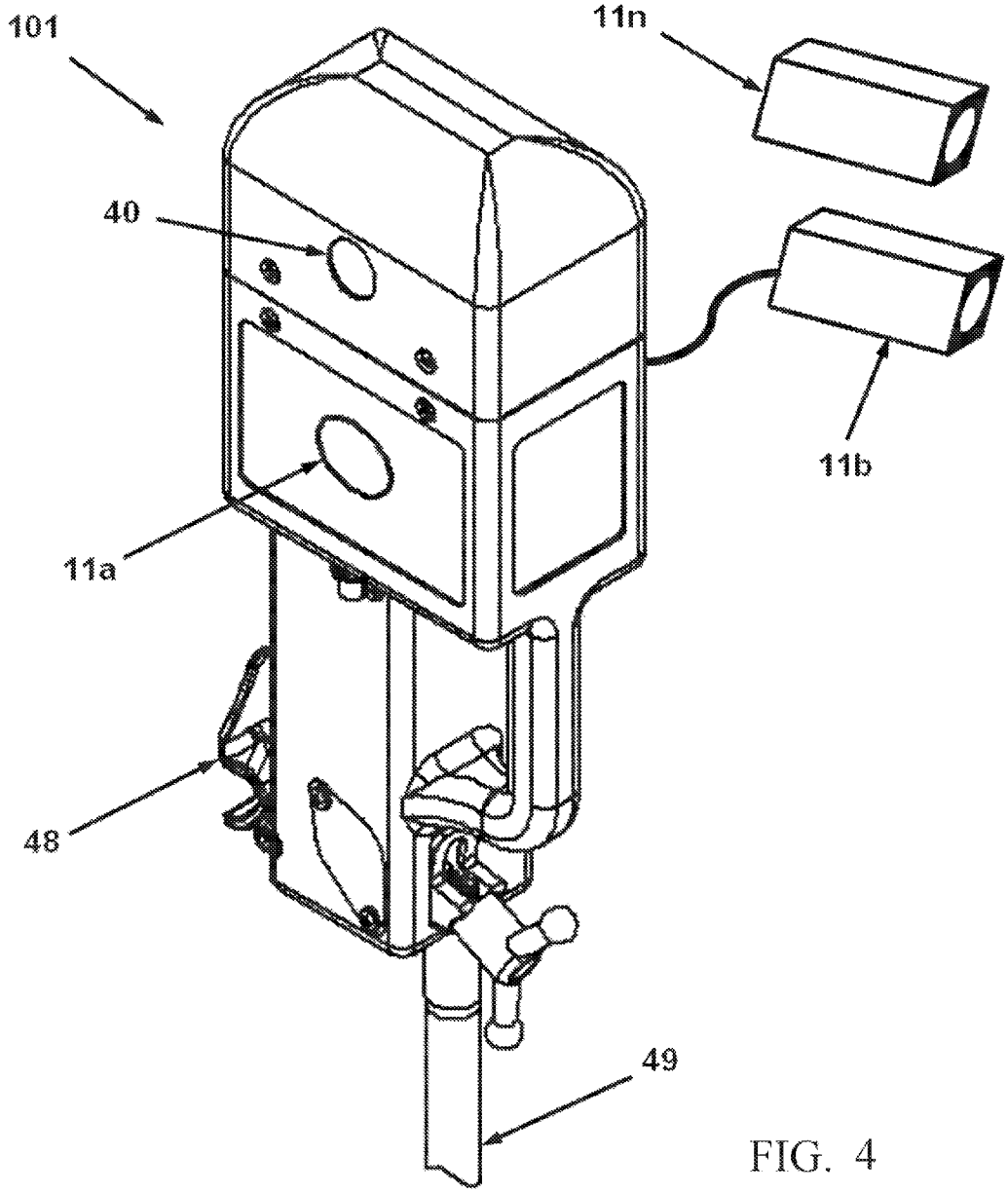
FIG. 4 is a view of an end-of-train video system integrated into an EOT for use on trains with conventional air brakes.

FIGS. 3 and 3A show the end of train video device 101, which is powered from battery 46 and/or air powered generator 47. FIG. 4 shows the end of train video device 101 connecting to the train air brake system with hose 49, which supplies compressed air to the air motor generator.

FIG. 4 also shows a camera 11*a* mounted in an end of train video device 101. The end of train video device 101 is generally attached to the side of the trailing coupler on the last car of a train with conventional EOT coupler mount 48, which orients the camera to capture views of the vicinity of the end of the train. Additional cameras may be used to capture other views of the vicinity of the train end. These cameras may also reside within the end of train video device 101, or as shown in FIG. 4, may be remote, standalone cameras (11*b* . . . 11*n*) that connect with wires to the end of train video device 101 or wirelessly transmit imaging data to and receive control commands from the end of train device 101. Good quality images or video may require the cameras be equipped with apparatus to aim, focus, zoom, or make other camera adjustments. FIG. 4 also shows an EOT flashing marker light 40 that is illuminated under dark conditions. Under dark conditions, camera imaging may need to be timed to coincide with illumination from the flashing marker light 40 or other lighting required by the cameras to capture meaningful images or video.

Returning to FIG. 3, observers at viewing stations 201 and 301 can transmit camera control commands to the end of train video system 101 with the radio transmitters 58 or 68 used to communicate conventional HOT messages, where they would be received by conventional EOT receiver 44 and processed using demodulator 43 and processor 42 as described above. The camera control commands could be appended to a conventional HOT radio message, or another independent HOT transmitter message could transmit the camera control commands. In either case, video or camera control commands originate in the processor 52 or 36 of viewing stations 201 and 301. The data is then sent to a modulator 57 or 67 and transmitter 58 or 68 that convert the electrical signals to a form suitable for transmission to the end of train system 101 using conventional means.

Alternately shown in FIG. 3A, the camera control commands can be transmitted in an independent message with a separate transmitter 28 or 38 to be received in the end of train device 101 by separate receiver 16 and processed using demodulator 17 and processor 42. Video or camera control commands originate in the processor 52 or 36 of viewing stations 201 and 301. The data is then sent to a modulator 27 or 37 and transmitter 28 or 38 for transmission to the end of train system 101 according to the present invention. Thus, video and camera control messages would be sent over a separate radio system from that used to send conventional EOT & HOT messages.

Note that all forms of the video and camera control command message would have a unique identifier code that uniquely identifies the end of train video device 101, such that the end of train video device 101 can discriminate between messages sent by other telemetry equipment on similarly equipped trains and viewing stations and messages sent by the transmitter on the intended train or viewing station. The end of train video device will then reject messages lacking the unique identifier code and only act on command messages bearing the unique identifier code sent by the transmitter on the intended train or viewing station. Based on the commands received in end of train processor 42, end of train processor 42 may send additional control signals to cameras (11*a*, 11*b* . . . 11*n*) and/or flashing marker light 40 as shown in FIGS. 3 and 3A.

In addition to the transmission and receipt of real-time image or video data, the embodiments shown in FIGS. 3 and 3A may accomplish video recording of same through data storage devices 13, 23 or 33 as described above with reference to FIG. 2.

Figure 5:
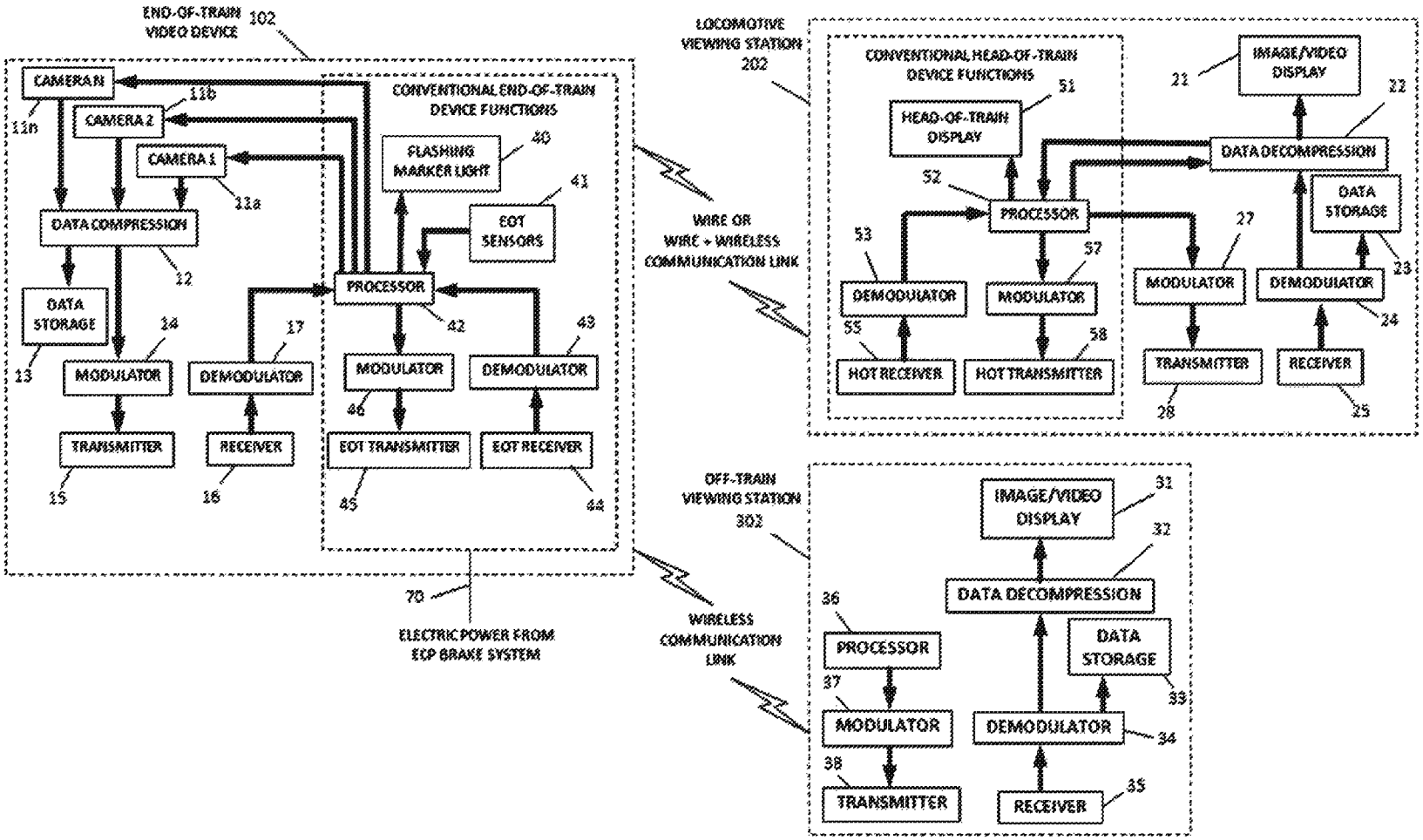
FIG. 5 is a block diagram of an end-of-train video system integrated into end-of-train telemetry equipment for trains with electronically controlled pneumatic (ECP) brakes.

FIG. 5 shows a block diagram of an end of train video system that has been made integral with end-of-train telemetry equipment for trains with ECP brakes. The end of train video device 102 has the conventional capabilities of an EOT augmented with a means to capture, transmit and record images or video, and locomotive viewing station 202 has the conventional capabilities of a HOT augmented with a means to receive & display video data from the end of train video device 102. The end of train video system communicates with the locomotive over the same wires used by conventional end-of-train telemetry devices lacking video capability with transmitters 45 or 58 and receivers 44 or 55. The end of train video system may alternately communicate image and video data and receive commands to/from the locomotive wirelessly with transmitters 15 or 28 and receivers 16 or 25. The end of train video system 102 communicates with the off-train viewing station 302 wirelessly using transmitters 15 or 38 and receivers 16 or 35.

The end of train video device transmitter 45 could send image or video data to the locomotive viewing station receiver 55 appended to the conventional EOT message, or in another independent message. Alternately, the image or video data could be wirelessly transmitted in an independent end of train video device 102 message from transmitter 15, and the image or video data would be received at the viewing stations 202, 302 by receivers 25 or 35.

Wireless image or video data messages would have a unique identifier code that uniquely identifies the end of train video device 102, such that the receiving viewing stations can discriminate between messages sent by other telemetry devices on similarly equipped trains and messages sent by the end of train video device 102 on the intended train. The viewing stations will then reject messages lacking the unique identifier code and only display image or video data from messages bearing the unique identifier code sent by the end of train video device 102 on the intended train.

Figure 6:
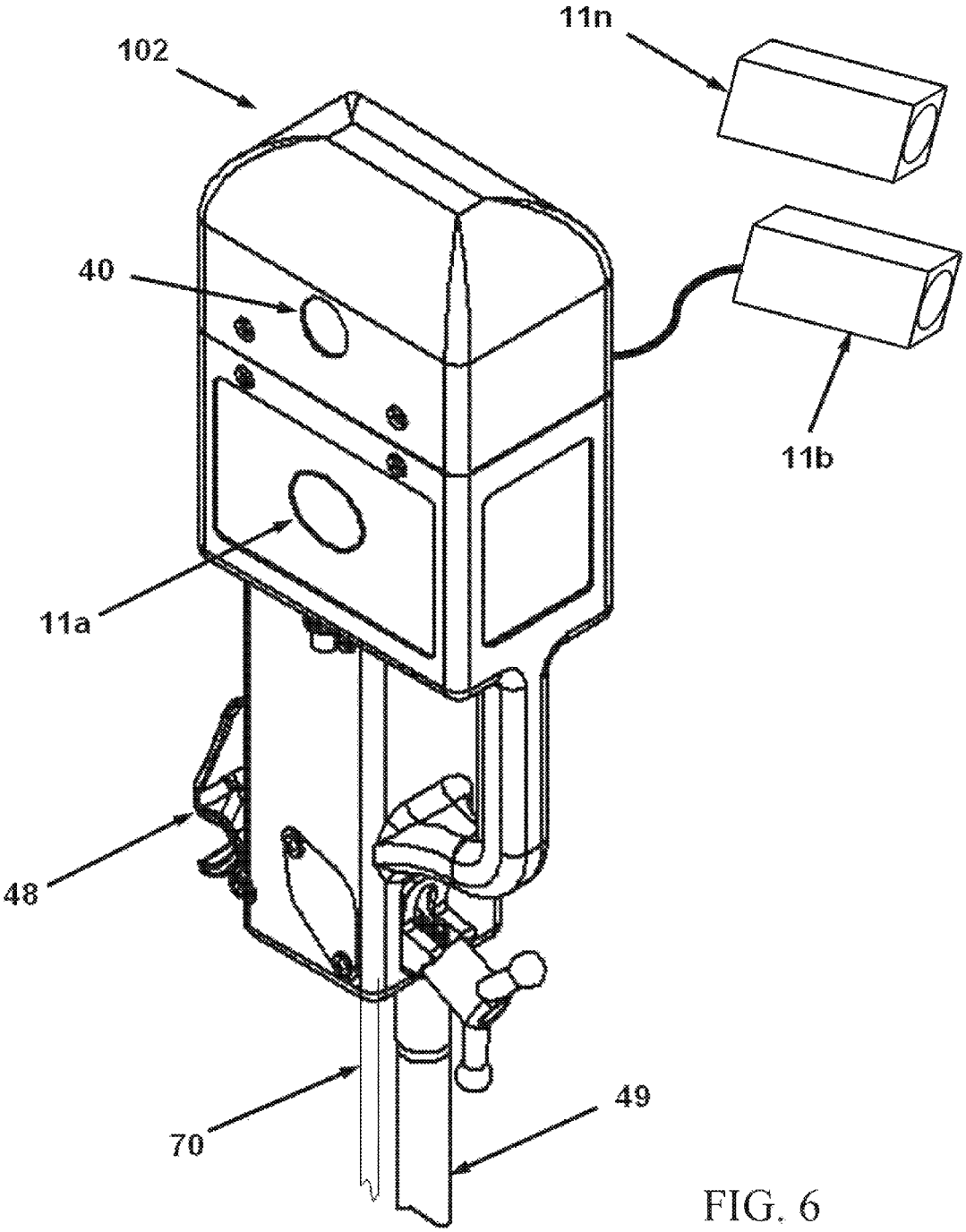
FIG. 6 is a view of an end-of-train video system integrated into an EOT for use on trains with ECP brakes.

In the instant embodiment, end of train video device 102 is powered from the ECP brake system. FIG. 6 shows the end of train video device 102 connecting to the ECP brake system with cable connection 70 and air hose 49. Cable connection 70 provides the wired communication link to the locomotive and electrical power from the train ECP brake system. Air hose 49 allows the device to monitor air brake pipe pressure on the train.

FIG. 6 also shows a camera 11*a* mounted in an end of train video device 102. The end of train video device 102 is generally attached to the side of the trailing coupler on the last car of a train with conventional EOT coupler mount 48, which orients the camera to capture views of the vicinity of the end of the train. Additional cameras may be used to capture other views of the vicinity of the train end. These cameras may also reside within the end of train video device 102, or as shown in FIG. 6, may be remote, standalone cameras (11*b* . . . 11*n*) that connect with wires to the end of train video device 102 or wirelessly transmit imaging data to and receive control commands from the end of train device 102. Good quality images or video may require the camera to be equipped with apparatus to aim, focus, zoom, or make other camera adjustments. FIG. 6 also shows an EOT flashing marker light 40 that is illuminated under dark conditions. Under dark conditions, camera imaging may need to be timed to coincide with illumination from the flashing marker light 40 or other lighting required by the camera to capture meaningful images or video.

Returning to FIG. 5, an observer at locomotive viewing station 202 can transmit camera control commands to the end of train video device 102 with the transmitter 58 and receiver 44 used to communicate conventional HOT messages. The camera control commands could be appended to a conventional HOT radio message, or another independent HOT transmitter message could transmit the camera control commands. Alternatively, observers at viewing stations 202 or 302 can wirelessly transmit camera control commands to the end of train device 102 with transmitters 28 or 38 and receiver 16. Wireless camera control command messages would have a unique identifier code that uniquely identifies the end of train video device 102, such that the end of train video device 102 can discriminate between messages sent by other telemetry equipment on similarly equipped trains and viewing stations and messages sent by the transmitter on the intended train or viewing station. The end of train video device 102 will then reject messages lacking the unique identifier code and only act on command messages bearing the unique identifier code sent by the transmitter on the intended train or viewing station.

In addition to the transmission and receipt of real-time image or video data, the embodiments shown in FIG. 5 may accomplish video recording of same through data storage devices 13, 23 or 33 as described above with reference to FIG. 2.

The remainder of the features of the present embodiment are more fully described with respect to FIGS. 2, 3 and 3A.

The end of train video system presents these advantages:

This invention provides a viewing system on a train and makes real time visual information in the form of images or video of the vicinity of the end of a train available to a locomotive operator or distant user. Real time images and video from an otherwise blind area will make train operation safer.

The system records images or video of the vicinity of the end of a train such that the images or video can be recalled and used at a later time. Recorded images or video from an otherwise blind area will improve accident and security investigations, training and other activities.

The end of train viewing system may be combined and integrated within EOT and HOT equipment to increase the functionality of conventional end-of-train telemetry devices.

Therefore, having now fully set forth the preferred embodiment and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth in the previously described embodiments.

What is claimed is:

1. A train viewing system for the capture of real time visual information in the form of images or video of the vicinity of the end of a train and transmission of that visual information to a locomotive the system comprising:

one or more imaging devices positioned in said vicinity of the end of the train for capturing imaging data therefrom;

a data compression processor in communication with said one or more imaging devices for compressing the imaging data therefrom and formatting the imaging data into compressed data, a processor for appending a unique identifier code to said compressed data;

a modulator for converting said compressed data and unique identifier code into a modulating signal for modulating a transmitter;

a transmitter in communication with said modulator for transmitting a message containing said compressed data and unique identifier code to a locomotive; and a receiver located in said locomotive for receiving said message transmitted from said transmitter;

a demodulator for demodulating said compressed data and unique identifier code from said message;

a data decompression processor in communication with said demodulator for decompressing the compressed data into decompressed imaging data and validating said unique identifier code; and a video display located in said locomotive for viewing said decompressed imaging data when said unique identification code is valid.

2. A train viewing system as described in claim 1, further comprising an end-of-train device at the end of said train, at least one of said one or more imaging devices residing within said end-of-train device, and said unique identifier code uniquely identifies said end-of-train device.

3. A train viewing system as described in claim 2, wherein electrical power for said one or more imaging devices and transmitter is supplied by a train ECP brake cable.

4. A train viewing system as described in claim 2, further comprising a received positioned in a vicinity of the end of the train for reception of control commands from said locomotive for said one or more imaging devices.

5. A train viewing system as described in claim 4, wherein said end-of-train device receives emergency valve commands on a telemetry system, and said receiver is integral with said end-of-train device telemetry system.

6. A train viewing system as described in claim 4, wherein said end-of-train device receives emergency valve commands on a telemetry system, and said receiver is separate from said end-of-train device telemetry system.

7. A train viewing system as described in claim 4, wherein said receiver is a wireless receiver.

8. A train viewing system as described in claim 2, wherein said transmitter comprises a wireless radio for transmitting said message containing said compressed data and unique identifier to said receiver wirelessly.

9. A train viewing system as described in claim 8, wherein said end-of-train device transmits brake pipe pressure data on a radio system, and said wireless radio transmitter is integral with said end-of-train device radio system.

10. A train viewing system as described in claim 8, where said end-of-train device transmits brake pipe pressure data on a radio system, and said wireless radio transmitter is separate from said end-of-train device radio system.

11. A train viewing system as described in claim 2, wherein said transmitter transmits said compressed data to said receiver located in said locomotive via train ECP brake system wire.

12. A train viewing system as described in claim 2, wherein said end-of-train device includes a marker light, and said marker light provides imaging illumination for said one or more imaging devices.

13. A train viewing system as described in claim 2, further comprising an air motor in said end-of-train device for supplying electrical power for said one or more imaging devices and transmitter.

14. A train viewing system as described in claim 2, further comprising a battery in said end-of-train device for supplying electrical power for said viewing system to said one or more imaging devices and transmitter.

15. A train viewing system as described in claim 1, further comprising an end-of-train device at the end of said train, at least one of said one or more imaging devices being remote from said end-of-train device, and said unique identifier code uniquely identifying said end-of-train device.

16. A train viewing system as described in claim 15, wherein said at least one imaging device transmits imaging data to and receives control commands from said end-of-train device.

17. A train viewing system as described in claim 16, wherein said at least one imaging devices wirelessly transmits said imaging data to or wirelessly receives said control commands from the end of train device.

18. A train viewing system as described in claim 1, where said receiver located in said locomotive comprises a head-of-train device radio.

19. A train viewing system for the capture of real time visual information in the form of images or video of the vicinity at the end of the train and transmission of that visual information to a remote location off the train, the system comprising:

one or more imaging devices positioned in said vicinity of the end of the train for capturing imaging data therefrom;

a data compression processor in communication with said one or more imaging devices for compressing the imaging data therefrom and formatting the imaging data into compressed data;

a processor for appending a unique identifier to said compressed data;

a modulator for converting said compressed data and unique identifier into a form capable of modulating a transmitter;

a transmitter for transmitting said compressed data and unique identifier to a remote location;

a receiver located in said remote location for receiving said compressed imaging data and unique identifier transmitted from said transmitter;

a demodulator for demodulating said compressed data and unique identifier from said message;

a data decompression processor in communication with said demodulator for decompressing said compressed data back into imaging data and validating said unique identifier; and a video display located in said remote location for viewing said decompressed imaging data when said unique identifier is valid.

20. A train recording system for recording information in the form of compressed data of images or video of the vicinity of the end of the train and storing it for later use, the system comprising:

a means for attachment to a trailing coupler of a trailing train car;

one or more imaging devices positioned in said vicinity of the end of the train for capturing said images or video therefrom;

a data compression processor in communication with said one or more imaging devices for compressing said images or video and formatting into compressed data;

a data recorder in communication with said data compression processor for preserving said compressed data on data storage.

21. An end-of-train device capable of capturing real time visual information in the form of images or video of the vicinity of the end of a train and transmission of that visual information to a locomotive or other remote locations, the end-of-train device comprising:

means for attachment to a trailing coupler of a trailing train car;

one or more imaging devices for capturing imaging data in the vicinity of the end of the train;

a processor in communication with said one or more imaging devices that adds a unique identifier code to said captured imaging data to uniquely identify said end-of-train device; and a wireless transmitter for broadcast transmitting a wireless message containing said imaging data and unique identifier code to a locomotive and other remote locations a wireless receiver for receiving said wireless message transmitted from said wireless transmitter.

22. The train viewing system of claim 21, wherein said receiver is in communication with a processor programmed to accept wireless messages containing said unique identifier code and to reject other messages lacking said unique identifier code.

23. An end-of-train device, capable of capturing real time visual information in the form of images or video of the vicinity of the end of a train and transmission of that visual information to a locomotive or other remote locations, the end-of-train device comprising:

a means for attachment to a trailing coupler of a trailing train car;

one or more imaging devices for capturing imaging data in the vicinity of the end of the train;

a processor in communication with said one or more imaging devices, said processor being configured to compress said imaging data and format the imaging data into compressed data;

a processor for appending a unique identifier code to said compressed data, identifying the source of the compressed data to users; and a wireless transmitter for broadcast transmitting a wireless message representing said compressed data with said unique identifier code to a locomotive or other remote locations; and a wireless receiver for receiving said wireless message transmitted from said wireless transmitter.

24. A train viewing system for the capture of real time visual information in the form of images or video of the vicinity of the end of a train and transmission of that visual information to a locomotive or remote location in a wireless message containing compressed data and a unique identifier code, comprising:

one or more imaging devices positioned in said vicinity of the end of the train for capturing imaging data therefrom;

an end-of-train device configured for attachment to a trailing coupler of a trailing train car, said end of train device further comprising, a data processor in communication with said one or more imaging devices for compressing the imaging data therefrom and formatting the imaging data into compressed data, a processor for appending a unique identifier code to said compressed data, and a transmitter for transmitting a wireless message representing said compressed data with a unique identifier to a locomotive or remote location; and a wireless receiver located in said locomotive or remote location for receiving said wireless message data transmitted from said end of train device;

wherein said wireless message is received by a wireless receiver located in said locomotive or remote location.

25. The train viewing system of claim 24, wherein said unique identifier code uniquely identifies the wireless transmitter.

26. The train viewing system of claim 24, wherein said receiver is in communication with a processor that is configured to accept wireless messages containing a valid unique identifier code and to reject messages lacking the valid unique identifier code.

27. A train recording system for recording information in the form compressed data of images or video of the vicinity of the end of a train and storing it for later use in a locomotive, the system comprising:

one or more imaging devices positioned in said vicinity of the end of the train for capturing imaging data therefrom;

a data compression processor in communication with said one or more imaging devices for compressing the imaging data therefrom and formatting the imaging data into compressed data;

a processor for appending a unique identifier code to said compressed data;

a modulator for converting said compressed data and unique identifier code into a modulating signal for modulating a transmitter;

a transmitter in communication with said modulator for transmitting a message containing said compressed data and unique identifier code to a locomotive; and a receiver located in said locomotive for receiving said message transmitted from said transmitter;

a demodulator for demodulating said compressed data and unique identifier code from said message;

a processor in communication with said demodulator for validating said unique identifier code; and a recorder in communication with said processor, located in said locomotive, for preserving said compressed data when said unique identification code is valid.

28. A train recording system for recording information in the form compressed data of images or video of the vicinity of the end of a train and storing it for later use at a remote location off the train, the system comprising:

one or more imaging devices positioned in said vicinity of the end of the train for capturing imaging data therefrom;

a data compression processor in communication with said one or more imaging devices for compressing the imaging data therefrom and formatting the imaging data into compressed data;

a processor for appending a unique identifier code to said compressed data;

a modulator for converting said compressed data and unique identifier code into a modulating signal for modulating a transmitter, a transmitter in communication with said modulator for transmitting a message containing said compressed data and unique identifier code to a locomotive;

a receiver located in said locomotive for receiving said message transmitted from said transmitter;

a demodulator for demodulating said compressed data and unique identifier code from said message;

a processor in communication with said demodulator for validating said unique identifier code; and a recorder in communication with said processor, located at a remote location off the train, for preserving said compressed data when said unique identification code is valid.

* * * * *